US009126604B2

(12) United States Patent
Mayer

(10) Patent No.: US 9,126,604 B2
(45) Date of Patent: Sep. 8, 2015

(54) LONGITUDINALLY REINFORCED RAILWAY VEHICLE

(75) Inventor: Wilhelm Mayer, Gänserndorf (AT)

(73) Assignee: Siemens AG Oesterreich, Vienna (AT)

( * ) Notice: Subject to any disclaimer, the term of this patent is extended or adjusted under 35 U.S.C. 154(b) by 111 days.

(21) Appl. No.: 13/391,489

(22) PCT Filed: Jul. 19, 2010

(86) PCT No.: PCT/EP2010/060377

§ 371 (c)(1),
(2), (4) Date: Feb. 21, 2012

(87) PCT Pub. No.: WO2011/026684

PCT Pub. Date: Mar. 10, 2011

(65) Prior Publication Data

US 2012/0145034 A1 Jun. 14, 2012

(30) Foreign Application Priority Data

Sep. 2, 2009 (AT) ..... A 1379/2009

(51) Int. Cl.
*B61F 1/00* (2006.01)
*B61D 17/10* (2006.01)

(52) U.S. Cl.
CPC .. *B61F 1/00* (2013.01); *B61D 17/10* (2013.01)

(58) Field of Classification Search
CPC ..... B61F 1/00; B61F 1/02; B61F 1/12; B62D 25/2054; B61D 17/10
USPC ..... 105/413, 414, 415, 416, 417, 418, 419, 105/421, 422
See application file for complete search history.

(56) References Cited

U.S. PATENT DOCUMENTS

| | | | | |
|---|---|---|---|---|
| 1,551,202 | A | 8/1925 | Merryman | |
| 2,299,421 | A * | 10/1942 | Essl | 105/172 |
| 2,851,316 | A * | 9/1958 | Thomson | 384/125 |
| 3,022,128 | A * | 2/1962 | Reuter | 384/125 |
| 3,313,246 | A * | 4/1967 | Koo | 105/454 |
| 3,626,464 | A | 12/1971 | Van Der Sluys | |
| 6,910,428 | B2 * | 6/2005 | Laflamme et al. | 105/413 |

FOREIGN PATENT DOCUMENTS

| | | | |
|---|---|---|---|
| DE | 595854 | C | 4/1934 |
| DE | 956962 | C | 1/1957 |
| DE | 961545 | C | 4/1957 |
| DE | 95800 | A3 | 2/1973 |
| DE | 3531820 | A1 | 3/1987 |
| DE | 29708953 | U1 | 6/1998 |
| FR | 2789016 | A1 | 8/2000 |
| GB | 855233 | A | 11/1960 |
| RU | 2028236 | C1 | 2/1995 |

* cited by examiner

*Primary Examiner* — Mark Le
(74) *Attorney, Agent, or Firm* — Laurence A. Greenberg; Werner H. Stemer; Ralph E. Locher

(57) ABSTRACT

A longitudinally reinforced railway vehicle includes a body, longitudinal girders, cross-girders, and reinforced carriage ends. Reinforcement tubes which are guided within recesses of the cross-girders are arranged in the longitudinal direction between the reinforced carriage ends.

11 Claims, 3 Drawing Sheets

LONGITUDINALLY REINFORCED RAILWAY VEHICLE

CROSS REFERENCE TO RELATED APPLICATIONS

This application is the U.S. National Stage of International Application No. PCT/EP2010/060377 filed Jul. 19, 2010, and claims the benefit thereof. The International Application claims the benefits of Austrian Application No. A1379/2009 AT filed Sep. 2, 2009. All of the applications are incorporated by reference herein in their entirety.

TECHNICAL FIELD

The invention relates to a longitudinally reinforced railway vehicle.

PRIOR ART

Railway vehicles, in particular passenger vehicles, are nowadays mostly made as self-supporting metal constructions. In this case, a vehicle body shell is constructed from an under-frame, end walls and a roof. The under-frame must withstand the operational forces, especially the load, coupling pressure and tractive forces. To this end, the under-frame is often engineered as a framed construction and conventionally incorporates two outlying longitudinal beams, several cross-members joining these longitudinal beams and, and is reinforced at the ends of the vehicle. This reinforcement is effected by means of so-called end-pieces at the end of the vehicle, and main cross-members which also incorporate the mountings for the bogies (or individual axles, as applicable). For the purpose of approval of railway vehicles, it is necessary to satisfy certain norms, which are often different for each country. Among other requirements, these norms call for a demonstration that the railway vehicle can withstand a certain longitudinal force (coupling pressure) undamaged. The norm, which applies for Europe, UIC-566, calls for a coupling pressure of 2000 kN to be demonstrated, the norm which applies for the USA calls for 3550 kN. Even if the European norm is well capable of satisfaction by means of two longitudinal beams, a railway vehicle which is to be approved for the USA involves higher constructional costs. In this case, additional longitudinal beams are typically built in, these being known as center sills. As early as 1911, center sills were used in one of the first passenger carriages made of steel. ("Pullman Sleeping Car Glengyle"; The American Society of Mechanical Engineers; http://files.asme.org/ASMEORG/Communities/History/Landmarks/5629.pdf).

To a specialist there are several known design solutions for the construction of center sills, for example US2002/0029721 proposes an under-frame construction made of two outlying and two inboard beams. U.S. Pat. No. 4,195,451 shows a single center sill, as does U.S. Pat. No. 3,631,811. A particularly costly design is disclosed in U.S. Pat. No. 5,746,335. This design decouples the vehicle body shell from the center sill by means of hydraulic components.

None of the known methods of construction makes it possible to build railway vehicles which can withstand very high coupling pressure but which can be manufactured with low design and material costs. Apart from this, the space requirement for conventional center sills is disadvantageous.

SUMMARY OF THE INVENTION

It is an object of the invention to specify a construction for a railway vehicle which can withstand a very high coupling pressure and at the same time is simple and cheap to manufacture.

This object is achieved by a longitudinally reinforced railway vehicle as claimed.

In accordance with the basic idea behind the invention, at least one reinforcing tube is passed between the reinforced ends of the carriage, through openings in the cross-members, and is joined to the reinforced ends of the carriage. Here, the reinforcing tubes are not joined, in particular not welded, to the cross-members at the openings in the cross-members. At their ends, the reinforcing tubes are joined to the reinforced ends of the carriage by means of suitable force channeling fixtures.

It is thereby possible to achieve the advantage of being able to manufacture a longitudinally reinforced railway vehicle with a significantly lower construction cost than is possible with the solutions conforming to the prior art. In particular, the construction cost of a welded center sill is eliminated, and also the space which is otherwise occupied by a center sill remains free for other built-in items.

The inventive solution simplifies the building of a longitudinally reinforced railway vehicle because, in accordance with the invention, the reinforcing tubes are not welded to the cross-members. This eliminates a large number of complicated welded joints.

It is of further advantage that, in accordance with the proposed solution, the entire compressive strength of the reinforcing tubes is used, because passing the reinforcing tubes through openings in the cross-members makes it impossible for them to buckle out of the latter. The normal distance between the cross-members in railway vehicles is generally adequate to prevent buckling of the reinforcing tubes.

An important feature of the invention forming the subject matter is the complete elimination of all welded joints between the reinforcing tubes and the cross-members, which makes it possible to use even non-weldable materials for the reinforcing tubes. Thus it is also possible to use carbon fiber or Kevlar tubes, for example. In particular, it also simplifies the use of (non-weldable) high-tensile steel.

The channeling of the compressive forces from the reinforced ends of the carriages into the reinforcing tubes is effected by means of suitable force channeling fixtures, which must be engineered according to the applicable pairing of materials and the spatial restrictions. If the pairing of the materials for the reinforced ends of the carriages and the reinforcing tubes is weldable, then the welding-together of these components is to be recommended. If welding is not possible or provided for, as applicable, then fixtures must be provided which are suitable for ensuring the reliable channeling of the forces into the reinforcing tubes and which compensate for the unavoidable length tolerances in the railway vehicle. For example, guide sleeves are to be recommended and, inlaid in these guide sleeves, wedges which compensate for the length tolerances.

The reinforcing tubes can also consist of solid material (reinforcing bars).

In accordance with the invention, provision is made to arrange the reinforcing tubes between the reinforced ends of the carriages. Here, one possibility is to arrange the reinforcing tubes between the two main cross-members, or alternatively between the two headstocks, wherein for the latter design the reinforcing tubes are passed through openings in the main cross-members.

In a preferred embodiment of this invention, the reinforcing tubes are used in addition for transporting liquid or gaseous media. In this case, the end faces of the reinforcing tubes must be closed off and suitable connecting fixtures provided, and the dimensions of the reinforcing tubes must be specified allowing for the reduction in compressive strength resulting from these connecting fixtures.

Equally advantageous is the use of the reinforcing tubes for the routing of electrical wires. In particular for the routing of high-voltage electrical wires, which would otherwise need to be fed in conductive tubes. Here it is also important that the reinforcing tubes are not welded to the cross-members, because this ensures that no irregularities due to welded joints can arise on the inner surface of the tube, which could damage the high voltage wires.

A further preferred embodiment provides that the reinforcing tubes are passed through sleeves, which are introduced into the spaces between the openings in the cross-members and the reinforcing tubes. These sleeves will typically be made of plastic, and will improve the passage of the reinforcing tubes, so that even minor buckling is prevented, and eliminate practically any noise arising from the reinforcing tubes. In addition, these sleeves increase the load bearing capacity of the reinforcing tubes in an axial direction, because they prevent even minor buckling of the reinforcing tubes.

DETAILED DESCRIPTION OF THE INVENTION

Figure 1:
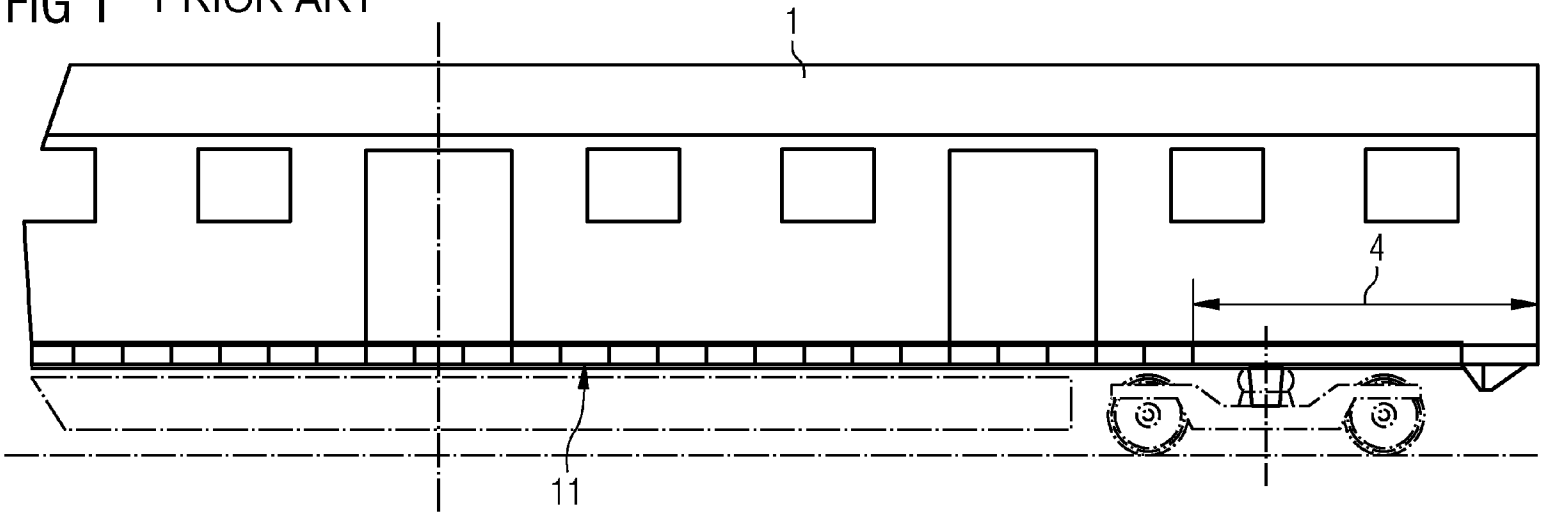
FIG 1 PRIOR ART
FIG. 1 a railway vehicle in accordance with the prior art.

FIG. 1 shows, by way of example and schematically, a railway vehicle in accordance with the prior art. A railway vehicle incorporates a carriage body shell 1 and an under-frame 11 together with further components (axles, wheels etc.). The under-frame 11 is joined to the carriage body shell 1 and together with the carriage body shell 1 it bears its own weight and that of the load. Tensile and compressive forces are taken up and transferred solely by the under-frame 11, for which purpose a reinforced carriage end 4 is provided at both ends of the under-frame 11. This reinforced carriage end 4 takes up the forces introduced by the buffers or coupling drawhooks (or center coupling), as applicable.

Figure 2:
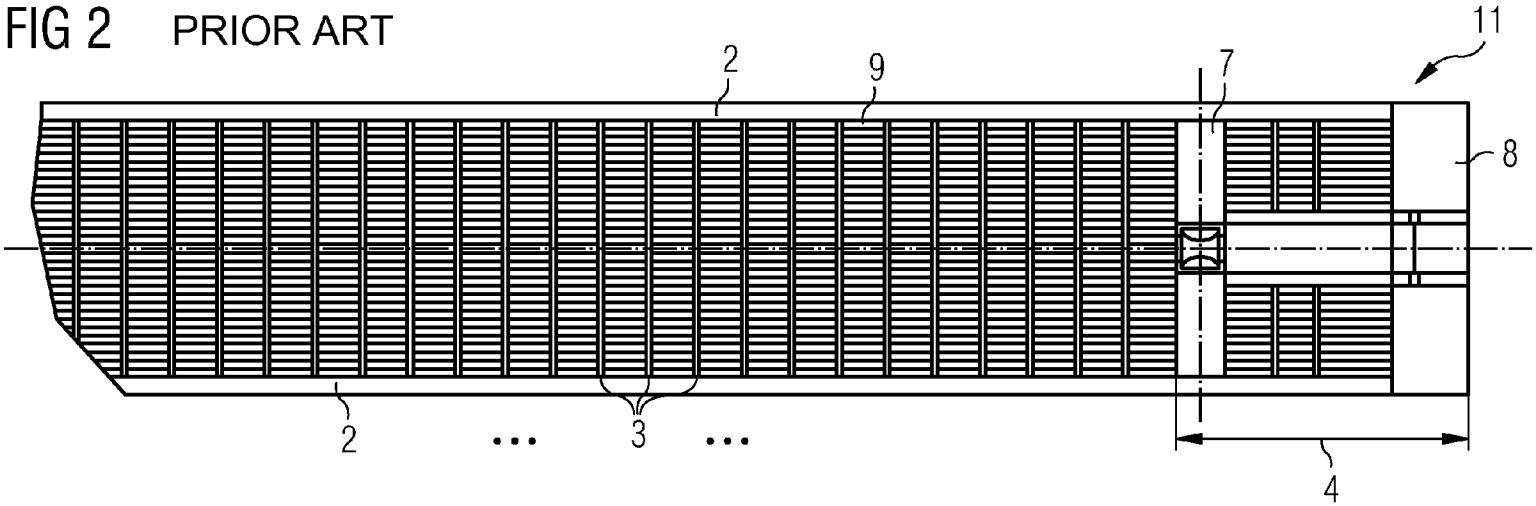
FIG 2 PRIOR ART
FIG. 2 an under-frame for a railway vehicle in accordance with the prior art.

FIG. 2 shows, by way of example and schematically, an under-frame for a railway vehicle, in accordance with the prior art. The view shows an under-frame 11 from beneath. The under-frame 11 incorporates two longitudinal beams 2, several cross-members 3, a main cross-member 7 and a headstock 8. The longitudinal beams 2 extend over the entire length of the railway vehicle, between the headstocks 8, and together with the cross-members 3 form a frame which affords the railway vehicle the necessary rigidity. This frame is planked with a floor 9 which can, for example, consist of corrugated metal sheet and which forms the basis for the passenger floor structure. At each of the two ends of the under-frame 11, a reinforced carriage end 4 is provided. This reinforced carriage end 4 incorporates a headstock 8 and a main cross-member 7. These components are exceptionally solidly constructed, because all the loadings and operational forces are channeled through them. The main cross-members 7 are fitted with a mounting fixture for a bogie or an axle, as applicable, the headstocks 8 have mounting fixtures for buffers and couplings. In the exemplary embodiment shown in FIG. 2, the main cross-member 7 and the headstock 8 of a reinforced carriage end are joined to a short centrally positioned longitudinal beam. Compressive forces in the longitudinal direction of the railway vehicle can be transmitted almost exclusively by the two longitudinal beams 2, because the carriage body shell 1 (not shown in FIG. 2) is not suitable for transmitting compressive forces, due to its construction.

Figure 3:
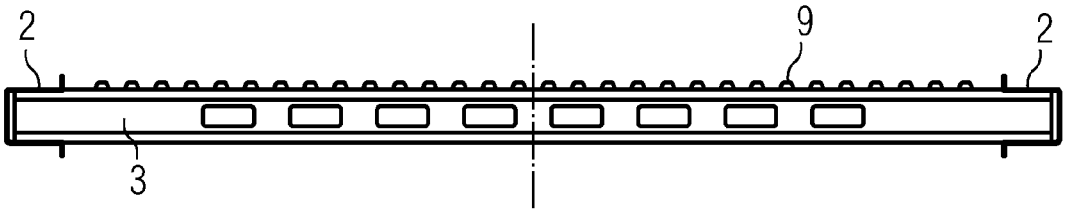
FIG 3 PRIOR ART
FIG. 3 a sectional view through an under-frame for a railway vehicle in accordance with the prior art.

FIG. 3 shows by way of example and schematically a sectional view through an under-frame of a railway vehicle in accordance with the prior art. This shows a section through an under-frame 11 across the longitudinal direction of the railway vehicle. The two longitudinal beams 2 are joined by a cross-member 3 which, for the purpose of saving weight, have holes in it. In the exemplary embodiment shown, the two longitudinal beams 2 are essentially U-shaped in construction. A floor 9 of corrugated metal sheet forms the lower external body shell of the railway vehicle.

Figure 4:
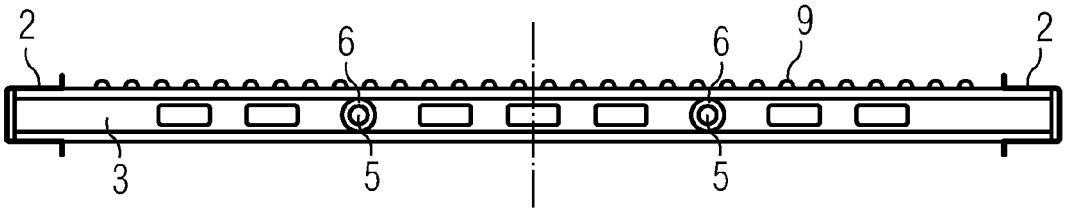
FIG. 4 a sectional view through an under-frame for a railway vehicle in accordance with the invention.

FIG. 4 shows by way of example and schematically a sectional view through an under-frame of a railway vehicle in accordance with the invention. This shows a section through an under-frame 11 across the longitudinal direction of the railway vehicle, as in FIG. 3. In accordance with the invention, the cross-members 3 incorporate openings 6 through which reinforcing tubes 5 are passed. At the places where they pass through the cross-members 3, these reinforcing tubes 5 are not joined, in particular they are not welded, to the cross-members 3, or the openings 6 in the cross-members 3, as applicable. The reinforcing tubes 5 pass unattached through the openings 6 in the cross-members 3. In the exemplary embodiment illustrated, two reinforcing tubes 5 are shown, but any other number of reinforcing tubes 5 is possible. The openings 6 are designed such that they prevent the buckling of the reinforcing tubes 5. For this purpose, it is necessary that the openings 6 have a diameter which is only minimally greater than that of the reinforcing tubes 5.

Figure 5:
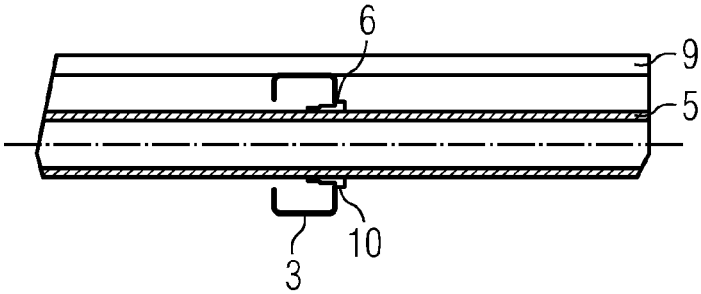
FIG. 5 the passage of a reinforcing tube through a cross-member.

FIG. 5 shows by way of example and schematically the passage of a reinforcing tube through a cross-member. It shows a longitudinal section through a reinforcing tube 5 in the region of its penetration through a cross beam 3. A sleeve 10 surrounds the reinforcing tube 5 and guides it within an opening 6 in the cross-member 3. During the assembly of the under-frame 11, this sleeve 10 is pushed onto the reinforcing tube 5, after which it is pushed into the opening 6. By this means, the reinforcing tube 5 is passed through the opening 6 with no play, by which means any noise generation is suppressed and the improved guidance of the reinforcing tube further reduces its buckling when it is subject to loading.

Figure 6:
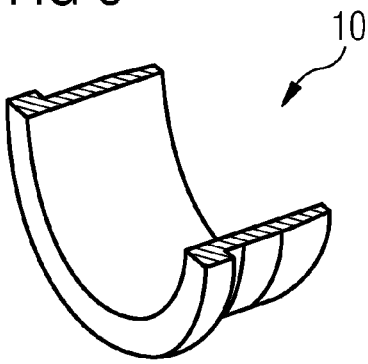
FIG. 6 a sleeve.

FIG. 6 shows by way of example and schematically a sleeve. This shows a three-dimensional view of a section through a sleeve 10. This single-part sleeve 10 can equally well be made in two parts so that it can also be mounted after assembly of the under-frame 11 has been carried out.

Figure 7:
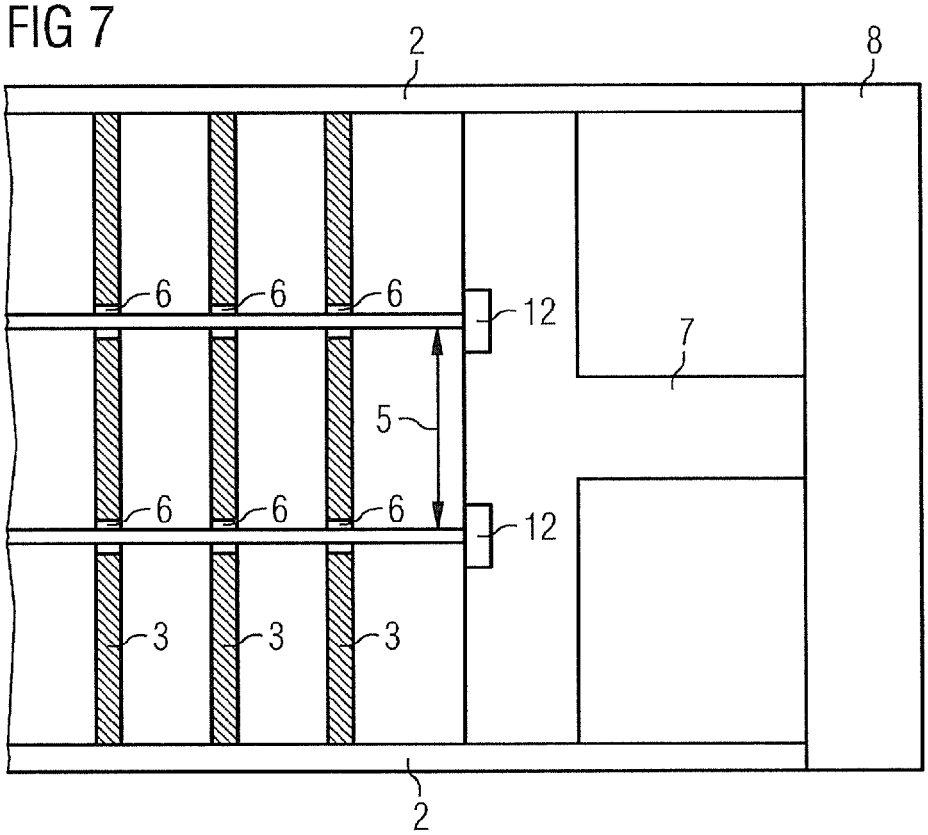
FIG. 7 an under-frame for a railway vehicle in accordance with the invention when a force is channeled in from the main cross-member.

FIG. 7 shows by way of example and schematically an under-frame of a railway vehicle in accordance with the invention, in which force is channeled in from the main cross-member. This shows a plan view of an under-frame 11 at one end of a railway vehicle. The other end of the railway vehicle is constructed as a mirror image. The under-frame 11 incorporates two longitudinal beams 1, several cross-members 3, two main cross-members 7 and two headstocks 8. The longitudinal beams 11 extend over the entire length of the railway vehicle between the headstocks 8 and together with the cross-members 3 form a frame. The cross-members 3 are shown as horizontally sectioned. Running between the main cross-members 7 at the two ends of the under-frame, in the longitudinal direction along the railway vehicle, are two reinforcing tubes 5. These reinforcing tubes 5 penetrate the cross-members 3, through openings 6 in these cross-members 3. The reinforcing tubes 5 are not joined to the cross-members 3 at the sites where they penetrate the latter. For the purpose of making this feature of the invention forming the subject matter clear, the openings 6 are shown over-enlarged. Into these openings, sleeves 10, like that shown in FIG. 5, can be inserted (not shown) in order to improve the guidance of the reinforcing tubes 5 and to prevent any noise generation. At each end of the reinforcing tube 5 is provided a force channeling fixture 12, which locates the end of each reinforcing tube 5 and channels the compressive forces from the main cross-member 7 into the reinforcing tubes 5. The engineering of this force channeling fixture 12 will be determined, among other matters, by the pairing of the materials for the reinforcing tube 5 and the main cross-member 7. If these materials can be welded to each other, then it is recommended that they should be welded at this location, which enables the force channeling fixture 12 to be particularly simply designed.

Figure 8:
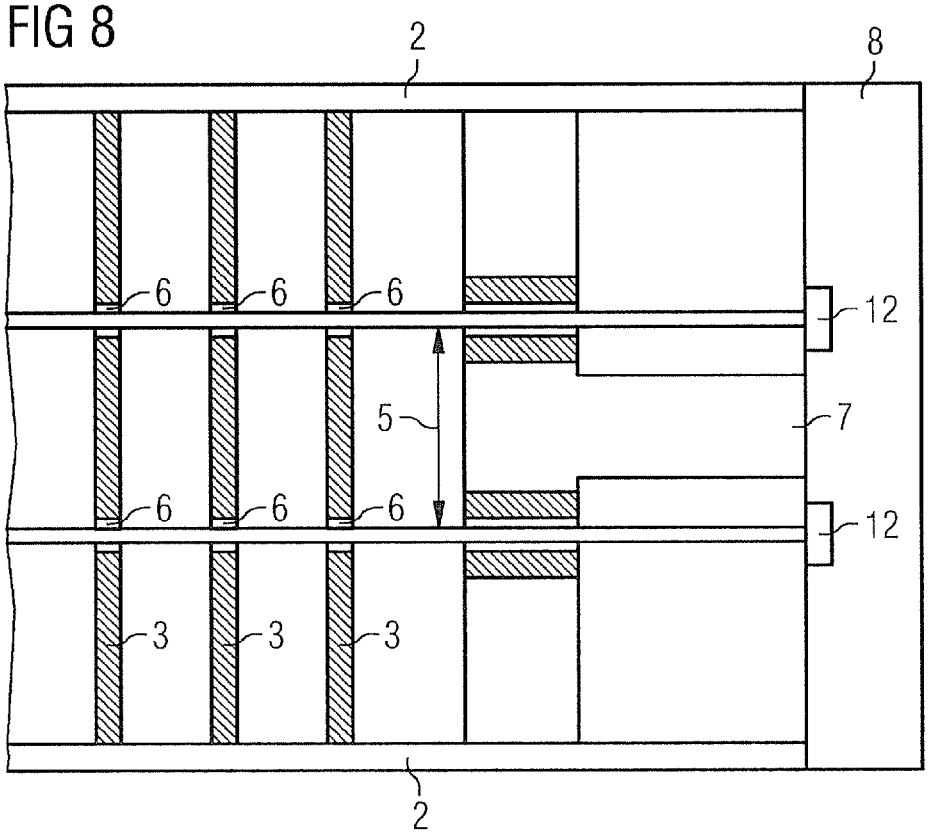
FIG. 8 an under-frame for a railway vehicle in accordance with the invention when a force is channeled in from the headstock.

FIG. 8 shows by way of example and schematically an under-frame of a railway vehicle in accordance with the invention, in which the force is channeled in from the headstock. The under-frame 11 from FIG. 7 is shown, with the force being channeled into the reinforcing tubes 5 directly from the headstock 8. The reinforcing tubes 5 run between the headstocks 8 at the two ends of the under-frame 11 and penetrate through not only the cross-members 3 but also the main cross-members 7. For the purpose of making this clear, the main cross-member 7 is shown as a partial section. It is to be recommended that where the reinforcing tubes 5 pass through the main cross-member 7 they are fitted with sleeves 10 (not shown). The present exemplary embodiment shows the principle of channeling forces from the headstock 8, in specific embodiments attention must be given to the maximum bearing span of the reinforcing tubes 5, in order to prevent any buckling of the reinforcing tubes 5. If necessary, additional support locations (cross-members) should be provided here.

The invention claimed is:

1. A longitudinally reinforced railway vehicle, comprising:

a carriage body shell, longitudinal beams, cross-members, and reinforced carriage ends formed with main cross-members, reinforcing tubes arranged in a longitudinal direction and extending between said reinforced carriage ends, and wherein said reinforcing tubes pass through openings formed in said cross-members and said reinforcing tubes extend from one of said main cross-members to the other of said main cross-members of said reinforced carriage ends with the terminal ends of the reinforcing tubes attached to the main cross members, and sleeves disposed to guide said reinforcing tubes in said openings in said cross-members.

2. The longitudinally reinforced railway vehicle as claimed in claim 1, wherein the reinforcing tubes are arranged between headstocks of the two carriage ends, and wherein the reinforcing tubes pass through openings of the main cross-members.

3. The longitudinally reinforced railway vehicle as claimed in claim 1, wherein the reinforcing tubes comprise solid material.

4. The longitudinally reinforced railway vehicle as claimed in claim 1, wherein the reinforcing tubes are welded to the reinforced carriage ends.

5. The longitudinally reinforced railway vehicle as claimed in claim 1, wherein the sleeves are made of plastic.

6. The longitudinally reinforced railway vehicle as claimed in claim 1, wherein each sleeve comprises several pieces.

7. The longitudinally reinforced railway vehicle as claimed in claim 5, wherein each sleeve comprises several pieces.

8. A reinforcing tube for a longitudinally reinforced railway vehicle, the railway vehicle having:

a carriage body shell, longitudinal beams, cross-members, and reinforced carriage ends with main cross-members, wherein the reinforcing tube is arranged in a longitudinal direction between the reinforced carriage ends, and wherein the reinforcing tube passes through openings of the cross-members and reaches from one of said main cross-members to another of said main cross members with the terminal ends of the reinforcing tubes attached to the main cross members, and sleeves are disposed to guide the reinforcing tube in the openings in the cross-members;

the reinforcing tube having openings formed in a side surface thereof and being closed off at ends thereof and including connections for liquid or gaseous media.

9. The reinforcing tube as claimed in claim 8, wherein the reinforcing tube is arranged between main cross-members of two carriage ends.

10. The reinforcing tube as claimed in claim 9, wherein the reinforcing tube is arranged between headstocks of the two carriage ends, and wherein the reinforcing tube passes through openings of the main cross-members.

11. The reinforcing tube as claimed in claim 8, wherein the reinforcing tubes comprise solid material.

* * * * *